US006386271B1

(12) United States Patent
Kawamoto et al.

(10) Patent No.: US 6,386,271 B1
(45) Date of Patent: May 14, 2002

(54) METHOD FOR CONTINUOUS CASTING OF STEEL

(75) Inventors: Masayuki Kawamoto; Masahito Hanao; Hirohisa Kikuchi; Toshihiko Murakami, all of Kashima; Masahiko Oka, Takarazuka, all of (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 0 days.

(21) Appl. No.: 09/539,613

(22) Filed: Mar. 31, 2000

(30) Foreign Application Priority Data

Jun. 11, 1999 (JP) ..... 11-166082

(51) Int. Cl.[7] ..... B22D 11/07
(52) U.S. Cl. ..... 164/472; 164/459
(58) Field of Search ..... 164/472, 418, 164/459

(56) References Cited

U.S. PATENT DOCUMENTS 3,700,024 A * 10/1972 Knell ..... 164/83
4,522,249 A * 6/1985 Mulcahy ..... 164/466
5,579,824 A * 12/1996 Itoyama et al. ..... 164/478
5,632,324 A * 5/1997 Nara et al. ..... 164/466
5,657,816 A * 8/1997 Harada et al. ..... 164/466
6,027,051 A * 2/2000 Heaslip et al. ..... 239/590.5
6,125,919 A * 10/2000 Hanao et al. ..... 164/472

FOREIGN PATENT DOCUMENTS

DE 3423475 A1 * 11/1984
JP 57-139457 * 8/1982
JP 61-74761 * 4/1986
JP 61119360 * 6/1986
JP 3-193248 8/1991
JP 5-15955 1/1993
JP 10-137911 * 5/1998
JP 8-33964 * 3/2000

* cited by examiner

*Primary Examiner*—M. Alexandra Elve
*Assistant Examiner*—Len Tran
(74) *Attorney, Agent, or Firm*—Armstrong, Westerman & Hattori, LLP

(57) ABSTRACT

A method of continuous casting of a steel employs a mold power having a viscosity of 0.5–1.5 poise at 1,300° C. and a solidification temperature of 1,190–1,270° C., in which the mass ratio of CaO to $SiO_2$ is 1.2–1.9, and casting is carried out under the following conditions: casting speed is 2.5–10 m/minute; mold oscillation stroke is 4–15 mm; and specific cooling intensity in secondary cooling of a slab is 1.0–5.0 liter/kg-steel.

11 Claims, 1 Drawing Sheet

METHOD FOR CONTINUOUS CASTING OF STEEL

This application claims priority under 35 U.S.C. §§119 and/or 365 to JP 11-166082 filed in Japan on Jun. 11, 1999, the entire content of which is herein incorporated by reference.

BACKGROUND OF THE INVENTION

1. Technical Field

The present invention relates to a method for continuous casting of a steel such as a peritectic steel at high speed. The method enables a steady operation due to a prevention of a break-out and an periodic fluctuation of molten steel level during the casting, and can produce a slab having excellent surface quality; i.e., a slab having no longitudinal cracks on the surface.

2. Background Art

In a method for continuous casting of a steel slab, in view of slab quality and productivity, generally, a slab with a thickness of 150–300 mm is cast at a speed of about 1–2 m/minute. In recent years, in consideration of reduction in construction cost of related equipment and the number of operators, casting of a slab with a thickness and shape similar to those of a product has been attempted. Particularly, in the production of hot coils, combination of a continuous casting method for a thin slab and a rolling method carried out by means of a simple hot strip mill arranged downstream on a casting line is in practical use. In such a simple hot strip mill, generally, a thin slab with a thickness of 40–80 mm is used as a material to be rolled.

It is difficult to practice a technique for casting a thin slab with a thickness of 40–80 mm by means of a generally used mold in which the inlet and outlet are of the same thickness. The thickness of a material used in a submerged entry nozzle cannot be increased, and the nozzle is susceptible to melting loss. Thus, in the course of casting, an accident in which the nozzle breaks and casting cannot be carried out may occur.

In order to solve such a problem, there is a method for casting a thin slab, employing a mold having an outlet thickness of 40–80 mm and an inlet thickness which is greater than the outlet thickness at a position at which a submerged entry nozzle is inserted. In another method for casting a thin slab, a thin slab with a thickness of 80 mm to 120 mm is cast by means of a mold in which the inlet and outlet are of the same thickness, and the slab containing a liquid core is subjected to reduction in a continuous casting apparatus, to thereby obtain a thin slab with a thickness of 40–80 mm. In either method, the thickness of a submerged entry nozzle can be increased, and breakage of the nozzle due to melting loss thereof rarely occurs. Hereinafter, a method of continuous casting of the above-described thin slab will be described generally as a continuous casting methods for obtaining a thin slab with a thickness of 40–120 mm.

In a simple hot strip mill arranged on a casting line, which follows continuous casting of thin slabs, productivity is as high as approximately 200–400 ton/hour, and thus two continuous casting apparatuses may be installed to one hot strip mill. However, in order to facilitate the operation of both the continuous casting apparatus and the strip mill, generally, one continuous casting apparatus is arranged. When only one continuous casting apparatus is employed, casting must be carried out at a speed of at least 3–5 m/minute in order to maintain productivity of the hot strip mill.

However, when casting speed increases, the amount of molten slag which flows into a gap between the inner wall of a mold and a solidified shell decreases. Here, a molten slag is formed from a mold powder which is added to the surface of molten steel in a mold and melted. When the inflow amount of molten slag decreases and the thickness of molten slag decreases, a solidified shell tends to bind to the inner wall of a mold, due to insufficient lubrication. Therefore, in an extreme case, break-out may occur. In order to maintain the inflow amount of molten slag, mold powder with a lower solidification temperature and viscosity is employed. However, when mold powder with a lower solidification temperature and viscosity is employed, the thickness of molten slag tends to be uneven. Thus, a solidified shell in a mold is not cooled evenly, and longitudinal cracks tend to form on the surface of a slab.

Incidentally, it is well known that a molten steel of a peritectic steel is solidified unevenly, and thus longitudinal cracks tend to form on the surface of a peritectic steel slab.

As described above, when peritectic steel is cast at a speed of at least 3–5 m/minute to thereby obtain a thin slab with a thickness of 40–120 mm, longitudinal cracks form in a considerable amount on the surface of the slab due to synergistic effects of uneven solidification and high-speed casting. In addition, break-out tends to occur because of insufficient lubrication.

In order to prevent formation of longitudinal cracks on the surface of a slab in the case in which the slab is cast at high speed, the following methods are proposed. Japanese Patent Application Laid-Open (kokai) No. 193248/1991 discloses a method in which oxides of elements belonging to Groups IIIA and IV, such as $ZrO_2$, $TiO_2$, $Sc_2O_3$, and $Y_2O_3$, are added to mold powder as crystallization accelerators. In the method, molten slag is crystallized when cooled from a molten state. A solidified shell in a mold is cooled gradually due to crystallization of the slag. When the solidified shell is cooled gradually, the cooling rate of the shell becomes even, and thus formation of longitudinal cracks on the surface of a slab can be prevented. In addition, in the method, the viscosity of molten slag is 1 poise or less at 1,300° C., and high-speed casting can be carried out.

Meanwhile, Japanese Patent Application Laid-Open (kokai) No. 15955/1993 discloses a method employing mold powder of low viscosity and high total $CaO/SiO_2$, the ratio of total CaO (mass %) to $SiO_2$ (mass %). In the method, total CaO refers to the sum of CaO contained in mold powder and CaO reduced from the amount of Ca which is assumed to be present as $CaF_2$. When total $CaO/SiO_2$ is as high as 1.2–1.3, molten slag is crystallized when cooled from a molten state. As described above, formation of longitudinal cracks on the surface of a slab can be prevented, due to crystallization of the slag.

However, even when the above methods disclosed in Japanese Patent Application Laid-Open (kokai) Nos. 193248/1991 and 15955/1993 are employed for casting peritectic steel at a speed of at least 3–5 m/minute to thereby obtain a thin slab with a thickness of 40–120 mm, in practice, formation of longitudinal cracks on the surface of the slab and break-out tend to occur. In addition, periodic fluctuation of molten steel level in the vertical direction may occur. In an extreme case, molten steel comes out from the inlet of a mold, and operation cannot be continued. Practically, such a problem has not been solved yet until now.

In view of the foregoing, an object of the present invention is to provide a method of continuous casting of a steel, which method enables a steady operation due to preventing an occurrence of a break-out and an periodic fluctuation in molten steel level in the course of continuous casting of a steel such as a peritectic steel at a high speed of 2.5–10 m/minute, and can produce a slab having no longitudinal cracks on the surface.

BRIEF SUMMARY OF THE INVENTION

The continuous casting method of the present invention is a method for casting a steel such as a peritectic steel at a high speed of 2.5–10 m/minute, in which the steel is cast under the conditions that chemical composition and physical properties of mold powder, mold oscillation, and secondary cooling condition are controlled in a particular range. Mold powder employed in the present invention has a viscosity of 0.5–1.5 poise at 1,300° C., and a solidification temperature of 1,190–1,270° C. In the mold powder, the ratio of CaO (mass %) to $SiO_2$ (mass %), $CaO/SiO_2$, is 1.2–1.9. A mold oscillation stroke is 4–15 mm, and a specific cooling intensity in secondary cooling of a slab is 1.0–5.0 liter/kg-steel.

In the continuous casting method of the present invention, a mean flow rate of molten steel in a horizontal direction is 20–50 cm/second in the meniscus of molten steel at a position which is located at a distance of ¼ width of the cavity of the mold from the inside wall of the mold in a width direction, and at a distance of ½ thickness of the cavity of the mold from the inside wall of the mold in a thickness direction. The maximum flow rate is preferably 120 cm/second or less in the meniscus of molten steel at the same position mentioned above. Under these conditions, formation of longitudinal cracks on the surface of a slab can be effectively prevented.

In the continuous casting method of the present invention, a slab containing a liquid core is preferably subjected to reduction before completion of solidification. Thus, a slab with a thickness of 40–80 mm can be obtained from a thin slab with a thickness of from more than 80 mm to 120 mm.

Furthermore, in the continuous casting method of the present invention, the ratio of CaO (mass %) to $SiO_2$ (mass %), $CaO/SiO_2$, in mold powder, is preferably 1.2–1.9. Under the conditions, formation of longitudinal cracks on the surface of a slab can be effectively prevented. In addition, lubrication between the inner wall of a mold and a solidified shell is enhanced, and thus occurrence of break-out can be effectively prevented.

The method of continuous casting of a steel of the present invention is preferably applicable to cast, in particular, a steel containing C in an amount of 0.065–0.18 mass %. Steel containing C in the above amount is so-called peritectic steel. As described above, when peritectic steel is cast, longitudinal cracks tend to form on the surface of a slab and periodic fluctuation of molten steel level may occur. The continuous casting method of the present invention is very effective in solving such problems.

DETAILED DESCRIPTION OF PREFERRED EMBODIMENTS

Figure 1:
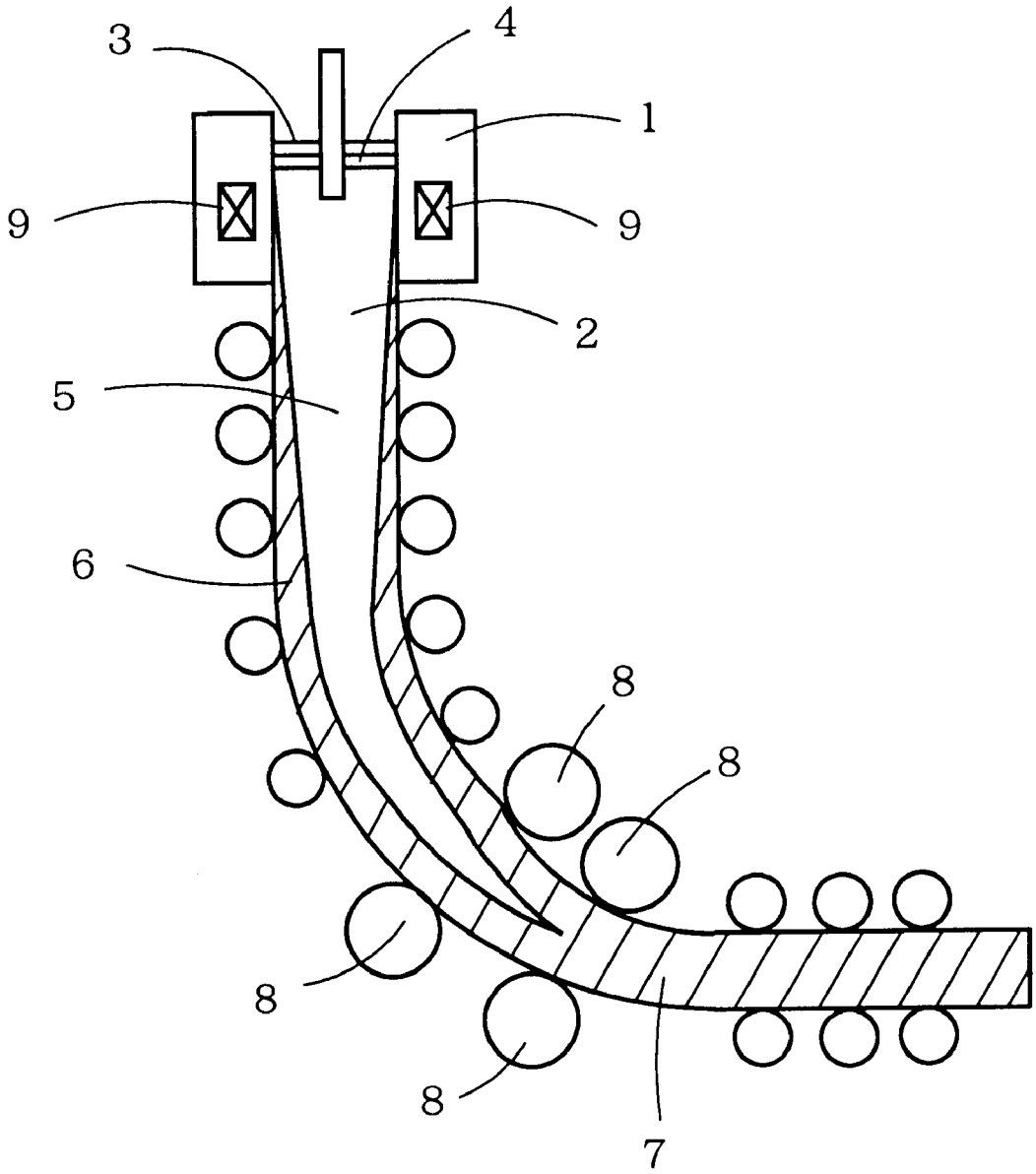
FIG. 1 is a schematic view showing the constitution of a continuous casting apparatus and the state of a slab in the course of casting, provided for explanation of the method of the present invention.

The continuous casting method of the present invention will next be described in detail.

The physical properties and chemical composition of mold powder employed in the method of the present invention are as follows. The viscosity of mold powder in a molten state at 1,300° C. is 0.5–1.5 poise. When the viscosity is in excess of 1.5 poise, molten slag encounters difficulty in flowing into a gap between the inner wall of a mold and a solidified shell. As a result, the shell tends to penetrate into the inner wall of the mold, and in an extreme case, break-out may occur. In addition, molten slag becomes thin and the mold absorbs a large amount of heat from the solidified shell, and thus longitudinal cracks tend to form on the surface of the slab. In contrast, when the viscosity is less than 0.5 poise, a very large amount of molten slag flows into the gap between the solidified shell and the inner wall of the mold, and an inflow amount of molten slag tends to differ depending on the position of the mold. As a result, the thickness of the solidified shell of the slab varies across a width direction of the slab, and thus longitudinal cracks tend to form on the surface of the slab.

The solidification temperature of molten slag falls within a range of 1,190 to 1,270° C. When the temperature is less than 1,190° C., a large amount of molten slag flows into a gap between the inner wall of a mold and a solidified shell, and the thickness of a liquid layer of molten slag increases. In addition, the thickness of a liquid layer of molten slag tends to differ depending on the position of the mold. As a result, the thickness of the solidified shell of the slab varies across a width direction of the slab, and thus longitudinal cracks tend to form on the surface of the slab. In contrast, when the temperature is in excess of 1,270° C., molten slag encounters difficulty in flowing into the gap between the inner wall of the mold and the solidified shell, and lubrication between the inner wall of the mold and the solidified shell may deteriorate. As a result, break-out tends to occur. In addition, molten slag tends to become thin, and the mold absorbs a large amount of heat from the solidified shell, and thus longitudinal cracks tend to form on the surface of the slab. Furthermore, solidified molten slag, which is called slag rope, may form, and when slag rope is taken in the solidified shell, break-out may occur. In order to determine the solidification temperature of molten slag, the viscosity of molten slag is measured while molten slag is cooled. The temperature at which the viscosity increases drastically is regarded to be the solidification temperature.

The ratio of CaO (mass %) to $SiO_2$ (mass %), $CaO/SiO_2$, is determined to be 1.2–1.9. Ca contained in mold powder is reduced to CaO, and CaO refers to total CaO. For example, in the case of mold powder containing $CaF_2$, Ca in $CaF_2$ is reduced to CaO and the resultant CaO is included in total CaO.

When the ratio is less than 1.2, the thickness of glass layer increases in molten slag which flows into a gap between the inner wall of a mold and a solidified shell. Thus, the mold absorbs a large amount of heat from a slab, and longitudinal cracks tend to form on the surface of the slab. In contrast, when the ratio is in excess of 1.9, the solidification temperature becomes excessively high, and molten slag encounters difficulty in flowing into the gap between the inner wall of the mold and the solidified shell. As a result, lubrication between the inner wall of the mold and the solidified shell may deteriorate, and break-out tends to occur.

Molten slag in which the ratio $CaO/SiO_2$ is 1.2–1.9 is appropriately crystallized when cooled. A solidified shell in a mold is cooled gradually by crystallization of molten slag. When the solidified shell is cooled gradually, the cooling of the shell becomes uniform, and thus formation of longitudinal cracks on the surface of a slab is prevented.

The mass ratio of CaO to $SiO_2$, $CaO/SiO_2$, is preferably 1.2–1.9. Under these conditions, a solidified shell is cooled gradually and lubrication between the inner wall of a mold and the solidified shell may be maintained.

Fundamentally, mold powder contains the following compounds: CaO, $SiO_2$, $Na_2O$, and $CaF_2$ serving as a fluorine compound. Specifically, the chemical composition of mold powder is described below. As used herein, the symbol "%" refers to "mass %." Mold powder preferably contains CaO, 20–45%; $SiO_2$,10–30%; $Na_2O$,2–20%; and $CaF_2$,4–25%. If necessary, mold powder preferably further contains $Al_2O_3$, 0–5%; MgO,0–5%; and C,0–5%. $Al_2O_3$ exhibits the effect of increasing the viscosity and solidification temperature of molten slag. MgO exhibits the effect of lowering solidification temperature. C exhibits the effects of regulating the melting rate of mold powder, since C burns gradually. Mold powder may further contains $Li_2O$ or $ZrO_2$. $Li_2O$ or $ZrO_2$ exhibits the effect of regulating solidification temperature.

A raw material of mold powder contains oxides such as $Fe_2O_3$ and $Fe_3O_4$, and mold powder contains these oxides as impurities. However, since the impurities do not raise any problem, mold powder may contain them.

A mold oscillation stroke is determined to be 4–15 mm. When the stroke is less than 4 mm, in the case of mold powder employed in the method of the present invention, which has high solidification temperature and basicity, a small amount of molten slag flows into a gap between the inner wall of a mold and a solidified shell, and thus break-out tends to occur. In contrast, when the stroke is in excess of 15 mm, distortion may occur in a slab due to mold oscillation, and thus longitudinal cracks tend to form on the surface of the slab. A mold oscillation stroke is 4–15 mm, and thus molten slag appropriately flows into a gap between the inner wall of a mold and a solidified shell. Therefore, formation of longitudinal cracks on the surface of the slab and break-out can be prevented.

A specific cooling intensity in secondary cooling of a slab is determined to be 1.0–5.0 liter/kg-steel. When the amount is less than 1.0 liter/kg-steel, bulging tends to occur in a slab between pairs of guide rolls, and thus periodic fluctuation in molten steel level may occur. In an extreme case, molten steel comes out from the upper end of a mold, and operation may not be performed. In contrast, when the amount is in excess of 5.0 liter/kg-steel, the temperature of a slab becomes excessively low, and thus transverse cracks tend to form on the surface of the slab. In addition, the temperature of the slab at the outlet of a continuous casting apparatus decreases, and energy required to heat the slab before hot rolling becomes considerably high.

In the course of secondary cooling of a slab, in the region within 2 m downstream of the outlet of a mold with respect to a casting direction, the amount of cooling water which is applied to the surface of the slab is preferably 40–60 mass % of the total amount of cooling water employed in secondary cooling. When the amount of secondary cooling water is increased for a slab in the region in the vicinity of the downstream side of a mold outlet, occurrence of bulging is effectively suppressed. Thus, occurrence of periodic fluctuation in molten steel level can be prevented. When the amount is less than 40 mass %, occurrence of bulging is difficult to suppress, whereas when the amount is in excess of 60 mass %, the surface of a slab is cooled excessively, and transverse cracks tend to form on the surface.

In the meniscus of molten steel at a position which is located at a distance of ¼ width of the cavity of the mold from the inside wall of the mold in a width direction, and at a distance of ½ thickness of the cavity of the mold from the inside wall of the mold in a thickness direction, a mean flow rate of molten steel in a horizontal direction is determined to be 20–50 cm/second. The maximum flow rate is preferably 120 cm/second or less.

The term "meniscus of molten steel" refers to the region between the free surface of molten steel and the depth of 50 mm. The term "mean flow rate" refers to a mean value of flow rate over five minutes.

When casting is carried out under the above-described conditions, fluctuation in molten steel level in a mold is suppressed, and meniscus shape becomes even. In addition, position at which molten steel in a mold starts to solidify become uniform across a mold width direction, and thus formation of longitudinal cracks on the surface of a slab can be prevented.

When the mean flow rate is less than 20 cm/second, the temperature of the meniscus of molten steel in a mold becomes excessively low. Thus, melting of mold powder added to the mold is retarded, and a small amount of molten slag flows into a gap between the inner wall of the mold and a solidified shell. In this case, the mold absorbs a large amount of heat from the solidified shell, and thus longitudinal cracks tend to form on the surface of the slab. In the case that the mean flow rate is in excess of 50 cm/second, or the maximum flow rate is in excess of 120 cm/second, fluctuation in molten steel level becomes excessively high due to high flow rate, and evenness of the shape of meniscus tends to be poor. In this case, across a mold width direction, position at which molten steel in a mold starts to solidify tends to vary vertically, and thus the thickness of a solidified shell becomes uneven depending on the position in a slab width direction, and longitudinal cracks tend to form on the surface of the slab.

As a method for regulating the flow rate of molten steel in the meniscus in a mold, a method employing an electromagnetic brake is preferable. In the method, the flow rate is reduced by application of an electromagnetic force on the outlet flow of a submerged entry nozzle. The flow rate of molten steel in the meniscus is preferably measured by use of a molten steel flow rate measurement device based on the Karman vortex theory.

When the above-described conditions: viscosity and solidification temperature of mold powder; mass ratio of CaO to $SiO_2$, $CaO/SiO_2$; mold oscillation stroke; and specific cooling intensity in secondary cooling of a slab fall within respective ranges specified by the method of the present invention, occurrence of break-out, periodic fluctuation in molten steel level, and formation of longitudinal cracks on the surface of a slab can be prevented. In addition, the flow rate of molten steel in the meniscus in a mold preferably falls within a range specified by the method of the present invention. As a result, occurrence of break-out, periodic fluctuation in molten steel level, and formation of longitudinal cracks on the surface of a slab can be prevented more effectively.

The region of a slab containing a liquid core is preferably subjected to reduction before completion of solidification of the slab. When casting of a steel for the products requiring remarkable cleanliness; for example, when a slab used for producing a hot coil for an automobile, a relatively thick slab, e.g., a slab with a thickness of 80–120 mm, is cast, the region of a slab containing a liquid core is preferably subjected to reduction before completion of solidification of the slab. By means of reduction of a liquid core, a thin slab having remarkable cleanliness can be obtained.

When a slab containing a liquid core is subjected to reduction before completion of solidification of the slab, a thin slab with a thickness of 40–80 mm, which is required in a rolling method employing a simple hot strip mill, can be obtained. The reason why a slab is subjected to reduction before completion of solidification is that after solidification of the core is completed, it is difficult to subject a slab to reduction by means of a pair of reduction rolls of a conventional continuous casting apparatus. After completion of solidification, a slab must be subjected to reduction by application of a large reduction force by means of equipment similar to a rolling apparatus.

When the method of the present invention is applied, an employed continuous casting apparatus may be a vertical-bending-type continuous casting apparatus, a curved-type continuous casting apparatus, or another type of casting apparatus.

FIG. 1 is a schematic view showing the constitution of a continuous casting apparatus and the state of a slab in the course of casting, provided for explanation of the method of the present invention. FIG. 1 shows an example in which a vertical-bending-type continuous casting apparatus is employed. As shown in the example, an electromagnetic force from an electromagnetic brake 9 acts on a molten steel flow from a submerged entry nozzle in a mold, and in a curved portion after a vertical portion, a slab 7 containing a liquid core 5 is subjected to reduction by use of two pairs of reduction rolls 8.

A powder layer of added mold powder 3, and molten slag 4 are present on the surface of molten steel 2 in a mold 1. Added mold powder is melted by heat of molten steel, to thereby form molten slag. The molten slag flows into a gap between the inner wall and a solidified shell 6. A slab pulled from the lower end of the mold is subjected to secondary cooling by use of a cooling apparatus such as a spray nozzle (not shown in the figure). After completion of reduction, a slab is cut and fed to a hot strip mill.

EXAMPLE

In an apparatus of the constitution shown in FIG. 1, casting tests were performed by use of a vertical-bending-type continuous casting apparatus which comprises a slab reduction apparatus and an electromagnetic brake applying an electromagnetic force on molten steel flow from a submerged entry nozzle in a mold. The length of a vertical portion was 1.5 m, and the radius of a curved portion was 3.5 m.

Magnetic field intensity of the electromagnetic brake (molten steel flow regulation apparatus) was 0.3–0.5 tesla (T). The term "magnetic field intensity" refers to a magnetic field intensity at the position which is the coil center of the electromagnetic brake and the center in a thickness direction of the mold. The slab reduction apparatus was provided at the position 2.8 m away from the meniscus of molten steel.

Hypo-peritectic steel shown in Table 1 was cast into a slab with a thickness of 90 mm and a width of 1,200 mm by use of a mold whose inlet and outlet are of the same thickness. In each of casting tests, approximately 80 tons of molten steel was cast per heat. In some tests, a slab containing a liquid core was subjected to reduction. The chemical compositions of mold powder employed in the casting tests are shown in Table 2.

TABLE 1

(unit: mass %)

| C | Si | Mn | P | S | Al | N |
|---|---|---|---|---|---|---|
| 0.09–0.12 | 0.08–0.12 | 0.40–0.65 | 0.012–0.025 | 0.003–0.006 | 0.035–0.045 | 0.080–0.010 |

*) Balance: Fe and impurities

TABLE 2

| Type of mold powder | Physical properties: Viscosity *1 (poise) | Physical properties: Solidification temperature (° C.) | Chemical composition (unit: mass %, but $CaO/SiO_2$ represents ratio): CaO *2 | $SiO_2$ | $Na_2O$ | $CaF_2$ (F) | $Al_2O_3$ | MgO | Free C *3 | $CaO/SiO_2$ |
|---|---|---|---|---|---|---|---|---|---|---|
| a | 0.9 | 1210 | 42.4 | 32.7 | 10.0 | 20.5(10.0) | 2.1 | 0.8 | 2.0 | 1.3 |
| b | 0.5 | 1265 | 45.1 | 30.0 | 10.0 | 20.5(10.0) | 2.1 | 0.8 | 2.0 | 1.5 |
| c | 1.5 | 1195 | 43.1 | 36.0 | 8.0 | 16.4(8.0) | 2.1 | 0.8 | 2.0 | 1.2 |
| d | 0.9 | 1209 | 38.1 | 28.0 | 15.0 | 24.6(12.0) | 3.1 | 1.8 | 2.0 | 1.4 |
| e | 0.9 | 1201 | 35.1 | 28.0 | 16.0 | 24.6(12.0) | 4.1 | 2.8 | 2.0 | 1.3 |
| f | 1.0 | 1180 | 42.9 | 35.7 | 7.0 | 19.5(9.5) | 2.1 | 0.8 | 2.0 | 1.2 |
| g | 0.6 | 1280 | 46.3 | 30.8 | 9.0 | 18.5(9.0) | 2.1 | 0.8 | 2.0 | 1.5 |
| h | 0.5 | 1225 | 50.1 | 27.8 | 10.0 | 20.5(10.0) | 4.1 | 0.8 | 2.0 | 1.8 |
| i | 0.9 | 1190 | 38.2 | 34.7 | 9.0 | 18.5(9.0) | 2.1 | 5.0 | 2.0 | 1.1 *4 |
| j | 0.3 *4 | 1210 | 40.2 | 30.9 | 12.0 | 24.6(12.0) | 2.1 | 0.8 | 2.0 | 1.3 |
| k | 1.6 *4 | 1190 | 43.7 | 36.4 | 7.0 | 16.4(8.0) | 2.1 | 0.8 | 2.0 | 1.2 |
| m | 0.4 *4 | 1275 | 50.0 | 25.0 | 10.0 | 20.5(10.0) | 4.1 | 0.8 | 2.0 | 2.0 *4 |

*1) Viscosity at 1,300° C.
*2) Including Ca contained in $CaF_2$
*3) C which is not contained in compounds such as carbonate salts.
*4) Values marked with ____ fall outside the conditions specified by the present invention.

In casting tests, the mean flow rate of molten steel in a horizontal direction and the maximum value of flow rate were measured at the meniscus of molten steel at a position located at a distance of ¼ width of the cavity of the mold from the inside wall of the mold in a width direction, and at a distance of ½ thickness of the cavity of the mold from the inside wall of the mold in a thickness direction, by used of a molten steel flow rate measurement device based on the Karman vortex theory. Molten steel level in a mold was observed, and occurrence of break-out was detected by use of a vortex level meter.

In each of casting tests, three slabs having a length of 10 m in a casting direction were collected, and the number and the length of longitudinal cracks formed on the surface of the slab were measured. The lengths of longitudinal cracks were added, and the sum was divided by the number of the cracks, to thereby obtain a mean length of longitudinal cracks (m). Subsequently, the mean length was divided by the length of a slab (10 m), to thereby obtain a mean length of longitudinal cracks on the surface of a slab per m of slab (m/m). The conditions and results of the tests are shown in Tables 3 and 4.

TABLE 3

| Example | | | | | | | | | | |
|---|---|---|---|---|---|---|---|---|---|---|
| | Test conditions | | | | | | | Test results | | |
| | | | | | Flow rate of molten steel (cm/sec.) | | | | | |
| Test No. | Casting speed (m/min.) | Type of mold powder | Specific water volume (1/kg-steel) | Mold oscillation stroke (mm) | Mean flow rate | Maximum flow rate | Reduction of a slab containing a liquid core | Molten steel level in a mold | Break-out | Mean length of longitudinal cracks on the surface of a slab (m/m) |
| 1 | 2.5 | a | 1.9 | 9 | 30 | 70 | Not performed | Stable | Did not occur | 0 |
| 2 | 5.0 | a | 1.9 | 9 | 32 | 72 | Not performed | Stable | Did not occur | 0.01 |
| 3 | 10.0 | a | 1.9 | 10 | 45 | 100 | Not performed | Stable | Did not occur | 0.02 |
| 4 | 2.5 | d | 1.9 | 9 | 25 | 65 | Not performed | Stable | Did not occur | 0 |
| 5 | 5.0 | d | 1.9 | 9 | 27 | 70 | Not performed | Stable | Did not occur | 0 |
| 6 | 10.0 | d | 1.9 | 10 | 40 | 90 | Not performed | Stable | Did not occur | 0.01 |
| 7 | 5.0 | b | 1.9 | 9 | 31 | 73 | Not performed | Stable | Did not occur | 0.01 |
| 8 | 5.0 | c | 1.9 | 9 | 29 | 74 | Not performed | Stable | Did not occur | 0.05 |
| 9 | 5.0 | e | 1.9 | 9 | 30 | 75 | Not performed | Stable | Did not occur | 0 |
| 10 | 5.0 | e | 1.9 | 9 | 28 | 70 | Not performed | Stable | Did not occur | 0.01 |
| 11 | 5.0 | a | 1.2 | 9 | 32 | 72 | Not performed | Stable | Did not occur | 0.09 |
| 12 | 5.0 | a | 4.4 | 9 | 36 | 63 | Not performed | Stable | Did not occur | 0.01 |
| 13 | 5.0 | a | 1.9 | 4 | 35 | 74 | Not performed | Stable | Did not occur | 0.03 |
| 14 | 5.0 | a | 1.9 | 15 | 33 | 73 | Not performed | Stable | Did not occur | 0.09 |
| 15 | 5.0 | a | 1.9 | 9 | 22 | 45 | Performed | Stable | Did not occur | 0.03 |
| 16 | 5.0 | a | 1.9 | 9 | 48 | 90 | Performed | Stable | Did not occur | 0.03 |
| 17 | 5.0 | d | 1.2 | 9 | 30 | 70 | Not performed | Stable | Did not occur | 0.06 |
| 18 | 5.0 | d | 4.4 | 9 | 35 | 60 | Not performed | Stable | Did not occur | 0 |
| 19 | 5.0 | d | 1.9 | 4 | 30 | 74 | Not performed | Stable | Did not occur | 0.01 |
| 20 | 5.0 | d | 1.9 | 15 | 31 | 72 | Not performed | Stable | Did not occur | 0.06 |
| 21 | 5.0 | a | 1.9 | 9 | 18 | 42 | Not performed | Stable | Did not occur | 0.11 |
| 22 | 5.0 | a | 1.9 | 9 | 52 | 98 | Not performed | Stable | Did not occur | 0.13 |
| 23 | 5.0 | a | 1.9 | 9 | 48 | 125 | Not performed | Stable | Did not occur | 0.11 |
| 24 | 5.0 | f | 1.9 | 9 | 33 | 75 | Not performed | Stable | Did not occur | 0.11 |
| 25 | 5.0 | g | 1.9 | 9 | 29 | 71 | Not performed | Stable | Did not occur | 0.13 |
| 26 | 5.0 | h | 1.9 | 9 | 28 | 86 | Not performed | Stable | Did not occur | 0.12 |

TABLE 4

Comparative Example

| Test No. | Test conditions: Casting speed (m/min.) | Type of mold powder | Specific water volume (1/kg-steel) | Mold oscillation stroke (mm) | Flow rate of molten steel (cm/sec.): Mean flow rate | Maximum flow rate | Reduction of a slab containing a liquid core | Test results: Molten steel level in a mold | Break-out | Mean length of longitudinal crack on the surface of a slab (m/m) |
|---|---|---|---|---|---|---|---|---|---|---|
| 27 | 5.0 | j *1 | 1.9 | 9 | 31 | 78 | Not performed | Stable | Did not occur | 0.31 |
| 28 | 5.0 | k *1 | 1.9 | 9 | 30 | 72 | Not performed | Stable | Did not occur | 0.36 |
| 29 | 5.0 | i *1 | 1.9 | 9 | 31 | 74 | Not performed | Stable | Did not occur | 0.78 |
| 30 | 5.0 | m *1 | 1.9 | 9 | 31 | 69 | Not performed | Stable | Occurred | 0.38 |
| 31 | 5.0 | d | 0.9 *1 | 9 | 31 | 78 | Not performed | Great fluctuacion | Did not occur | 0.31 |
| 32 | 5.0 | d | 5.1 *1 | 9 | 34 | 76 | Not performed | Stable | Did not occur | 0.02 |
| 33 | 5.0 | d | 1.9 | 3 *1 | 32 | 69 | Not performed | Stable | Occurred | — |
| 34 | 5.0 | d | 1.9 | 16 *1 | 31 | 72 | Not performed | Stable | Did not occur | 0.28 |

Values marked with *1) fall outside the conditions specified by the present invention.

Test Nos. 1–3 of the Example employed mold powder which satisfies the conditions specified by the method of the present invention. The viscosity of molten slag at 1,300° C. was 0.9 poise, and $CaO/SiO_2$ (mass ratio) was 1.3. The casting speed was 2.5–10 m/minute. The mold oscillation stroke and specific cooling intensity in secondary cooling of a slab satisfied the conditions specified by the method of the present invention. The mold oscillation stroke was 9–10 mm, and the specific cooling intensity in secondary cooling of a slab was 1.9 l/kg-steel. In addition, in the respective tests, the flow rate of molten steel in a mold fell within a preferable range.

In Test Nos. 1–3, molten steel level was stable, and break-out did not occur. The mean length of longitudinal cracks on the surface of a slab was 0–0.02 m/m, and a slab of excellent surface quality was obtained. Incidentally, it is confirmed that when the mean length of longitudinal cracks is 0.10 m/m or less, defects do not form on the surface of a hot rolling steel strip, even when the surface of a slab is not subjected to any treatment.

Test Nos. 4–6 of the Example employed mold powder d, whose chemical composition falls within a preferable range. The remaining test conditions were almost the same as in Test Nos. 1–3.

In Test Nos. 4–6, molten steel level was stable, and break-out did not occur. The mean length of longitudinal cracks on the surface of a slab was 0–0.01 m/m, and a slab of more excellent surface quality as compared with Test Nos. 1–3 was obtained.

Test No. 7 of the Example employed mold powder b, which satisfies the conditions specified by the method of the present invention. The viscosity of molten slag at 1,300° C. was 0.5 poise and $CaO/SiO_2$ (mass ratio) was 1.5. Test No. 8 of the Example employed mold powder c, which satisfies the conditions specified by the method of the present invention. The viscosity of molten slag at 1,300° C. was 1.5 poise and $CaO/SiO_2$ (mass ratio) was 1.2. In Test Nos. 7 and 8, the casting speed was 5 m/minute, and the remaining test conditions were almost the same as in Test No. 2.

In Test Nos. 7 and 8, molten steel level was stable, and break-out did not occur. The mean length of longitudinal cracks on the surface of a slab was 0.01 or 0.05 m/m, and a slab of excellent surface quality was obtained.

Test Nos. 9 and 10 of the Example employed mold powder e, whose chemical composition falls within a preferable range. The remaining test conditions were almost the same as in Test Nos. 7 and 8.

In Test Nos. 9 and 10, molten steel level was consistent, and break-out did not occur. The mean length of longitudinal cracks on the surface of a slab was 0 or 0.01 m/m, and a slab of more excellent surface quality as compared with Test Nos. 7 and 8 was obtained.

Test Nos. 11–16 of the Example employed mold powder a, which satisfies the conditions specified by the method of the present invention. The casting speed was 5 m/minute. The mold oscillation stroke and specific water amount in secondary cooling of a slab satisfied the conditions specified by the method of the present invention. In Test Nos. 15 and 16, in the latter process of casting, a slab containing a liquid core was subjected to reduction, to thereby obtain a thin slab with a thickness of 50 mm.

In Test Nos. 11–16, molten steel level was consistent, and break-out did not occur. The mean length of longitudinal cracks on the surface of a slab was 0.01–0.09 m/m, and a slab of excellent surface quality was obtained. In Test Nos. 15 and 16, reduction of a slab was carried out without failure, to thereby obtain a thin slab with a thickness of 50 mm.

Test Nos. 17–20 of the Example employed mold powder d, whose chemical composition falls within a preferable range. The remaining test conditions were almost the same as in Test Nos. 11–16.

In Test Nos. 17–20, molten steel level was consistent, and break-out did not occur. The mean length of longitudinal cracks on the surface of a slab was 0–0.06 m/m, and a slab of more excellent surface quality as compared with Test Nos. 11–16 was obtained.

Test Nos. 21–23 of the Example employed mold powder a, which satisfies the conditions specified by the method of the present invention. The casting speed was 5 m/minute. The mold oscillation stroke and specific cooling intensity in secondary cooling of a slab satisfied the conditions specified by the method of the present invention. In Test Nos. 21–23, the mean flow rate and the maximum flow rate of molten steel in a mold fell outside preferable conditions.

In Test No. 21, the mean flow rate of molten steel was 18 cm/second. Thus, the temperature of the meniscus of molten steel in a mold was comparatively low, and melting of mold powder added to the mold was retarded. As a result, the amount of molten slag which flowed into a gap between the inner wall of the mold and a solidified shell was comparatively low, and some longitudinal cracks formed on the surface of a slab.

In Test Nos. 22 and 23, the mean flow rate and the maximum flow rate of molten steel were comparatively high. Thus, molten steel level fluctuated considerably. Across a width direction of the mold, a position at which molten steel in a mold starts to solidify fluctuated in the vertical direction, and thus the thickness of a solidified shell became uneven across a width direction of a slab. As a result, some longitudinal cracks formed on the surface of the slab.

Test Nos. 24 and 25 of the Example employed mold powders f and g, respectively, whose solidification temperatures fall outside a preferable temperature range. Test No. 26 of the Example employed mold powder h, which satisfies the conditions specified by the method of the present invention. In mold powder h, $CaO/SiO_2$ (mass ratio) was 1.8. In Test Nos. 24–26, the casting speed was 5 m/minute. The mold oscillation stroke and specific cooling intensity in secondary cooling of a slab satisfied the conditions specified by the method of the present invention. In addition, in the respective tests, the mean flow rate and the maximum flow rate of molten steel in a mold fell within a preferable range.

In Test No. 24, which employed mold powder f of low solidification temperature, a large amount of molten slag flowed into a gap between the inner wall of a mold and a solidified shell, and the thickness of a liquid layer of molten slag was comparatively large, and thus some longitudinal cracks formed on the surface of a slab. In Test No. 25, which employed mold powder g of high solidification temperature, flowing of molten slag into a gap between the inner wall of a mold and a solidified shell became slightly poor, and thus some longitudinal cracks formed on the surface of a slab. In Test No. 26, which employed mold powder h of high $CaO/SiO_2$ (mass ratio), flowing of molten slag into a gap between the inner wall of a mold and a solidified shell because slightly poor, and thus some longitudinal cracks formed on the surface of a slab.

Test Nos. 27–30 of the Comparative Example employed mold powders i, j, k, and m, respectively. In each of these mold powders, the viscosity of molten slag at 1,300° C., or $CaO/SiO_2$ (mass ratio) falls outside a range of the conditions specified by the method of the present invention. In Test Nos. 27–30, the remaining conditions were almost the same as in Test No. 2.

In Test No. 27, which employed mold powder j, in which the viscosity of molten slag at 1,300° C. is 0.3 poise, which is lower than the value specified by the method of the present invention, a large amount of molten slag flowed into a gap between the inner wall of a mold and a solidified shell. Thus, the inflow amount of molten slag was not constant in the mold, and the thickness of the solidified shell of a slab varied across a width direction of the slab. As a result, the mean length of longitudinal cracks on the surface of a slab was 0.31 m/m; i.e., considerably long longitudinal cracks formed. In Test No. 28, which employed mold powder k, in which the viscosity of molten slag at 1,300° C. is 1.6 poise, which is higher than the value specified by the method of the present invention, a small amount of molten slag flowed into a gap between the inner wall of a mold and a solidified shell. As a result, the mean length of longitudinal cracks on the surface of a slab was 0.36 m/m; i.e., considerably long longitudinal cracks formed. However, break-out did not occur.

In Test No. 29, which employed mold powder I, in which $CaO/SiO_2$ (mass ratio) is 1.1, which is lower than the value specified by the method of the present invention, the thickness of glass layer in molten slag was comparatively large, and thus a considerable amount of heat was absorbed from a mold. As a result, the mean length of longitudinal cracks on the surface of a slab was 0.78 m/m; i.e., considerably long longitudinal cracks formed.

In Test No. 30, which employed mold powder m, in which $CaO/SiO_2$ (mass ratio) is 2.0, which is higher than the value specified by the method of the present invention, a very small amount of molten slag flowed into a gap between the inner wall of a mold and a solidified shell, and break-out occurred in the course of casting.

Test Nos. 31–34 of the Comparative Example employed mold powder d, whose chemical composition falls within a range of preferable conditions, and a casting speed of 5 m/minute. In each of Test Nos. 31–34, the mold oscillation stroke or specific cooling intensity in secondary cooling of a slab fell outside a range of the conditions specified by the method of the present invention.

In Test No. 31, the level of molten steel gradually because unstable, and the casting speed had to be reduced to 2 m/minute in the course of casting. The mean length of longitudinal cracks of a slab at the position in which molten steel level fluctuated greatly was 0.31 m/m, and a large amount of longitudinal cracks formed, for the reason described below. Since the specific cooling intensity in secondary cooling of a slab was 0.9 l/kg-steel, which is lower than the value specified by the method of the present invention, considerable bulging occurred in the slab between pairs of guide rolls.

In Test No. 32, the specific cooling intensity in secondary cooling of a slab was 5.1 l/kg-steel, which is higher than the value specified by the method of the present invention. As a result, numerous transverse cracks formed on the surface of a slab, although few longitudinal cracks were formed. In addition, the surface temperature of a slab at the outlet side of a continuous casting apparatus was comparatively low, at 900° C. Generally, the surface temperature of a slab is 1,000–1,100° C.

In Test No. 33, in which the mold oscillation stroke was 3 mm, which is lower than the value specified by the method of the present invention, a small amount of molten slag flowed into a gap between the inner wall of a mold and a solidified shell, and thus break-out occurred immediately after initiation of casting.

In Test No. 34, in which the mold oscillation stroke was 16 mm, which is higher than the value specified by the method of the present invention, the stroke was very high, and thus distortion occurred in a slab. As a result, the mean length of longitudinal cracks on the surface of a slab was 0.28 m/m, and numerous longitudinal cracks formed.

What is claimed is:

1. A method for continuously casting of a steel, which comprises a steps of:

casting a steel into a slab while using a mold powder having a viscosity of 0.5 to 1.5 poise at 1,300 degrees C, a solidification temperature of 1,190 to 1,270 degrees C, and a mass ratio $CaO/SiO_2$ of 1.2 to 1.9, determining casting speed from 2.5 to 10 m/minute, wherein a mold oscillation stroke in a vertical direction is 4 to 15 mm, and a specific cooling intensity in secondary cooling of a slab is 1.0 to 5.o liter/kg-steel specific water flow rate, wherein a mean flow rate of molten metal in a horizontal direction is 20 to 50 cm/second, and the maximum flow rate of a molten in a horizontal direction is 120 cm/second in a meniscus of molten steel at a position which is located at a distance of ¼ width of a cavity of the mold from the inside wall of the mold in the width direction and at a distance of ½ thickness of the cavity of the mold from the inside wall of the mold in the thickness direction.

2. A method according to claim 1, which further comprises reducing a slab obtained by the method as recited in claim 1 so as to reduce a liquid-core area of the slab before completion of solidification.

3. A method according to claim 1, which further comprises reducing a slab obtained by the method as recited in claim 1 so as to reduce a liquid-core area of the slab before completion of solidification.

4. A method according to claim 1, wherein the mold powder has a mass ratio $CaO/SiO_2$ of 1.2 to 1.5.

5. A method according to claim 4, herein a mean flow rate of a molten steel in a horizontal direction is 20 to 50 cm/second, and the maximum flow rate of a molten steel in a horizontal direction is 120 cm/second in a meniscus of molten steel at a position which is located at a distance of ¼ width of the cavity of the mold from the inside wall of the mold in the width direction and at a distance of ½ thickness of the cavity of the mold from the inside wall of the mold in the thickness direction.

6. A method according to claim 4, which further comprises reducing a slab obtained by the method as recited in claim 4 so as to reduce a liquid-core area of the slab before completion of solidification.

7. A method according to claim 5, which further comprises reducing a slab obtained by the method as recited in claim 5 so as to reduce a liquid-core area of the slab before completion of solidification.

8. A method according to claim 1, wherein a steel has a C content of 0.065 to 0.18 mass %.

9. A method according to claim 1, wherein a steel has a C content of 0.065 to 0.18 mass %.

10. A method according to claim 4, wherein a steel has a C content of 0.065 to 0.18 mass %.

11. A method according to claim 5, wherein a steel has a C content of 0.065 to 0.18 mass %.

* * * * *